United States Patent [19]

Strauss

[11] Patent Number: 4,686,415

[45] **Date of Patent: * Aug. 11, 1987**

[54] TENSED MASK COLOR CATHODE RAY TUBE AND MASK SUPPORT FRAME THEREFOR

[75] Inventor: Paul Strauss, Chicago, Ill.

[73] Assignee: Zenith Electronics Corporation, Glenview, Ill.

[ * ] Notice: The portion of the term of this patent subsequent to Oct. 15, 2002 has been disclaimed.

[21] Appl. No.: 729,015

[22] Filed: Apr. 30, 1985

[51] Int. Cl.[4] ..... H01J 29/07; H01J 29/86

[52] U.S. Cl. ..... 313/402; 313/482; 313/477 R; 220/2.1 A

[58] Field of Search ..... 313/402, 407, 408, 288, 313/292, 477 R, 482; 220/2.1 A, 2.3 A

[56] References Cited

U.S. PATENT DOCUMENTS

| | | | |
|---|---|---|---|
| 2,761,990 | 9/1956 | Amdursky et al. . | |
| 3,440,469 | 4/1969 | Bradu et al. . | |
| 3,638,063 | 1/1972 | Tachikawa et al. . | |
| 3,873,874 | 3/1975 | Shinal . | |
| 3,894,321 | 7/1975 | Moore | 313/402 X |
| 4,069,567 | 1/1978 | Schwartz . | |
| 4,495,437 | 1/1985 | Kume et al. . | |
| 4,547,696 | 10/1985 | Strauss | 313/407 |

FOREIGN PATENT DOCUMENTS

| | | |
|---|---|---|
| 1163495 | 9/1969 | United Kingdom . |

*Primary Examiner*—David K. Moore
*Assistant Examiner*—K. Wieder
*Attorney, Agent, or Firm*—Cornelius J. O'Connor; Nicholas A. Camasto

[57] ABSTRACT

A support frame for supporting a tensed mask adjacent to a flat panel tube and wholly within the tube includes an outer flange, a shelf extending from the flange parallel to the flat panel and providing a support surface for the tensed mask and a skirt directed away from the flat panel and adapted to join with the remainder of the tube. The configuration provides a very rigid support frame for resisting deformation when not bonded to the other tube elements, such as during screening of the panel when the support frame alone bears the forces exerted by the tensed mask.

7 Claims, 4 Drawing Figures

TENSED MASK COLOR CATHODE RAY TUBE AND MASK SUPPORT FRAME THEREFOR

CROSS-REFERENCE TO RELATED APPLICATIONS

This application is related to but in no way dependent upon copending applications Ser. No. 538,001, now U.S. Pat. No. 4,593,224, and Ser. No. 538,003, now abandoned, both filed Sept. 30, 1983; Ser. No. 572,088, now U.S. Pat. No. 4,547,696, and Ser. No. 572,089, now U.S. Pat. No. 4,595,857, both filed Jan. 18, 1984; Ser. No. 646,861 now U.S. Pat. No. 4,614,892, and Ser. No. 646,862, now U.S. Pat. No. 4,593,225, both filed Aug. 31, 1984; and Ser. No. 735,887, now U.S. Pat. No. 4,656,388, filed May 17, 1985, all of common ownership herewith.

BACKGROUND OF THE INVENTION AND PRIOR ART

This invention relates generally to tension mask cathode ray tubes (tubes), and particularly to support frames therein for maintaining the tension mask in its tensed condition.

Color cathode ray tubes have been in existence for many years. The so-called shadow mask type of color tube is most popular and is generally constructed with a target or screen consisting of a regular pattern of photodeposited triads of red, green and blue light-emitting phosphors. The shadow mask is foraminous and positioned a predetermined distance from the target and, by virtue of its pattern of apertures, effectively shadows all but selected ones of the individual light-emitting phosphors from its corresponding electron beam-emitting source located in the neck of the tube. Since each tube's shadow mask is used in photoscreening the phosphor target therein, means for enabling repeatable, precise interregistration of the shadow mask and tube faceplate is a necessity. In most color cathode ray tubes, the shadow mask comprises a domed, foraminous metal sheet supported on a heavy frame. The mask is capable of self-maintaining its configuration and is repeatably positioned in registration with the tube panel by use of a plurality of studs embedded in the panel, and a corresponding plurality of stud-engaging flat springs attached to its supporting frame. The apparatus and screening techniques for such tubes are all well-known in the art and will not be described further herein.

The limitations of the shadow mask with respect to power-handling capability and image resolution are well-known. This invention concerns a novel "tensed mask" tube which utilizes a mask in the form of a thin foil having a pattern of suitable apertures. The mask is held under tension in a position adjacent to a flat or cylindrical phosphor screen-bearing face panel or faceplate. Since the foil mask is extremely thin, etching of the apertures therein can be very precisely controlled, thus making a higher resolution tube. Also, since the foil is under significant tension; that is, close to the deformation limit of the material used, it may be heated to a high temperature before the tension is relieved and mask distortion sets in. The electron energy that a tensed foil mask can absorb without significant degradation in color purity is much higher than for a conventional spherical shadow mask tube. Consequently, a much brighter, sharper image is possible with a tensed mask tube.

One of the inherent problems in a tensed mask tube is that the support structure for the mask must be capable of withstanding the relatively large tensile forces exerted by the mask thereon without substantial deformation. One mask-supporting technique described and claimed in the referent copending applications involves attaching the periphery of the mask to a glass support frame by means of a devitrifiable glaas, or "frit". The mask is typically composed of a steel having a coefficient of thermal expansion selected to be significantly higher than that of glass. The mask is sustained under modest tension and joined to the support frame with a bead of devitrifiable frit. The assembly is heated to a temperature at which the frit devitrifies. During the heat cycle, the steel mask expands at a much greater rate than the glass support frame, and when the frit devitrifies, it firmly bonds the periphery of the mask to the support frame. The mask is prevented from returning to its original size, and thereby is subjected to high tension forces; e.g., 30,000 psi.

As alluded to above, in accordance with conventional photographic techniques for fabricating the phosphor screens on the face panels of color tubes, the shadow mask is used as a stencil and must therefore be repeatedly positioned in accurate registration with the panel and with respect to the light source that simulate the electron beams developed by the electron gun. It will be appreciated that any deformation in the supporting structure for the tensed mask will result in corresponding distortions in the tensed mask aperture pattern during screening, and a corresponding distortion in the phosphor screen formed.

In accordance with the referent copending applications, the tensed mask support frame ultimately becomes a structural element of the tube envelope. During the assembly process, the entire tube structure, including panel, support frame and funnel, are subjected to an elevated temperature with devitrifiable frit on corresponding adjoining surfaces. When the frit devitrifies, a unified glass structure results which is hermetically sealed against the atmosphere. As the support frame and tensed mask are heated during the assembly process, the mask expands more than the frame, and the tension in the mask is greatly reduced. Deformation in the mask support frame is correspondingly reduced. As the devitrifiable frit vitrifies at the sealing temperature, the support frame is captured between the rigid panel and funnel or envelope portions of the tube. Upon subsequent cooling, the tension forces are again exerted by the tensed mask on the frame, but do not result in deformation of the support frame because it is now firmly supported by the face panel and the funnel. Thus the aperture pattern in the tensed mask of the finished tube differs from the distorted aperture pattern in the tensed mask when it was used to form the tube phosphor screen. Because of this fact, color impurity is apt to occur.

U.S. Pat. No. 3,894,321 to Moore, of common ownership herewith, is directed to a method for processing a color cathode ray tube having a thin foil mask sealed directly to the bulb. Included in this disclosure is a description of the sealing of a foil mask between the juncture of the skirt of the faceplate and the funnel. The foil mask is noted as having a greater thermal coefficient of expansion than the glass to which it is mounted, hence following a heating and cooling cycle in which the mask is cemented at the funnel-faceplate juncture, the greater shrinkage of the mask upon cooling places it under tension. The mask is shown as having two or more alignment holes near the corners of the mask which mate with alignment nipples in the faceplate. The nipples pass through the alignment holes to fit into recesses in the funnel. In another embodiment, the front panel is shown as having an inner ledge forming a continuous path around the tube, the top surface of which is a Q-distance away from the faceplate for receiving the foil mask such that the mask is sealed within the tube envelope. An embodiment is also shown in which the faceplate is skirtless and essentially flat.

The following patents are also noted. No. 1,163,495 (GB); U.S. Pat. Nos. 2,761,990; 3,440,469; 3,638,063; 3,873,874; 3,894,321; 4,069,567; and 4,495,437.

OBJECTS OF THE INVENTION

It is a principal object of this invention to provide a tensed mask cathode ray tube having improved color purity.

It is another object of this invention to provide a tensed mask cathode ray tube that is cost-effective in manufacture.

It is a more specific object of the invention to provide a tensed mask cathode ray tube so strengthened that an undistorted phosphor pattern can be formed on the face panel during screening.

BRIEF DESCRIPTION OF THE DRAWING

Further objects and advantages of the invention will be apparent upon reading the following description in conjunction with the drawings in which.

DESCRIPTION OF THE PREFERRED EMBODIMENT

Figure 1:
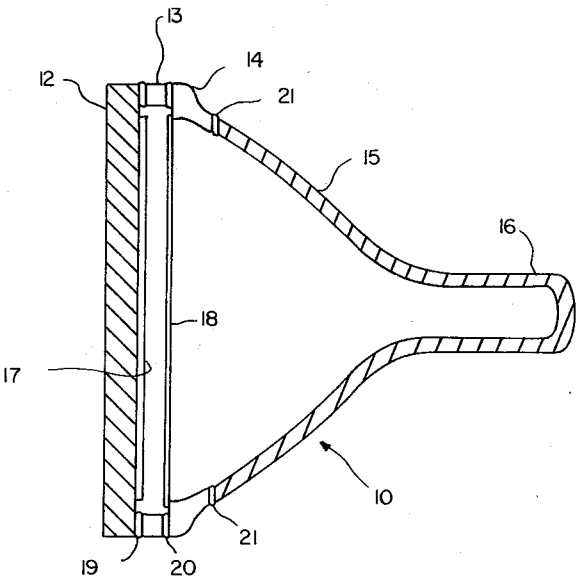
FIG. 1 represents a simplified cross-section of a tube constructed in accordance with the invention.

Referring to FIG. 1, a cathode ray tube 10 includes a flat or cylindrical glass panel or faceplate 12, a glass spacer frame 13, a glass support frame 14, constructed in accordance with the invention, and a generally bell-shaped funnel 15 that extends into a small diameter cylindrical neck 16 for housing an electron gun structure (not shown) of conventional form. Funnel 15 and support frame 14 are part of what is generally referred to as the envelope of tube 10. The inner surface of panel 12 has formed thereon, by a conventional photodeposition technique, a target or screen 17 consisting of a pattern of red, green and blue light-emitting phosphors related to the pattern of apertures in a confronting shadow mask 18 that is maintained under tension. The spacer 13, as is well understood in the art, is arranged to position tensed shadow mask 18 a predetermined distance from screen 17, which distance is generally referred to as the "Q" distance. The structural elements of the tube are joined together by devitrifiable frit junctions 19, 20 and 21, wherein the frit devitrifies at a high temperature to form a glass bond between the adjoining elements during manufacture of the tube. The support frame 14 as will be more fully explained, has a configuration according to the invention that imparts resistance to lateral deformation; that is, deformation in the plane of shadow mask 18.

Figure 2:
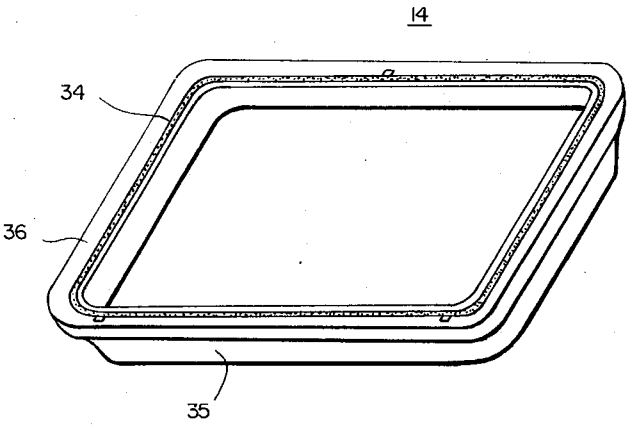
FIG. 2 is a perspective view of a support frame and tensed mask constructed in accordance with the invention.

FIG. 2 shows a perspective view of support frame 14 without tensed mask 18 being supported thereon. A flat seal surface 36 with a frit bead 34 is disposed about its inner periphery. The frit bead is used to support mask 18 on seal surface 36 in tension as indicated previously. A skirt 35, which extends away from the panel along the tube axis, is clearly illustrated. The support frame skirt is seen to extend along the direction of the tube axis for resisting inward deformation when subject to the forces of the tensed mask.

Figure 3:
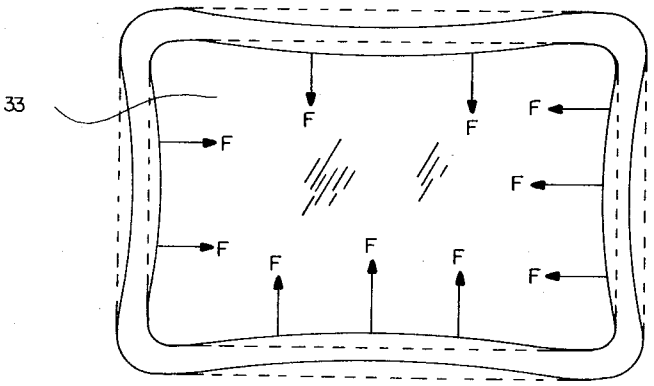
FIG. 3 is a plan view of a prior art support frame and tensed mask assembly with an exaggerated showing of the distortion experienced therein.

In FIG. 3 a plan view of a prior art shallow glass support frame not having the features of the present invention is shown to illustrate the deformation caused by forces exerted thereon by the tensed mask. The forces are generally indicated by the arrows labelled F. The dotted lines indicate the normal, untensed or unstrained outline of the support frame. The inward distortion that occurs under the tensed mask forces is shown by the solid lines. The distortion of the support frame will be understood to be exaggerated in this view for illustrative purpose. This distortion is "transferred" to the screen during screen formation because of the similarly distorted tensed shadow mask aperture pattern. Uowever, as realized in the finished tube, the distortion induced in the tensed shadow mask is relieved, and color impurity results.

Figure 4:
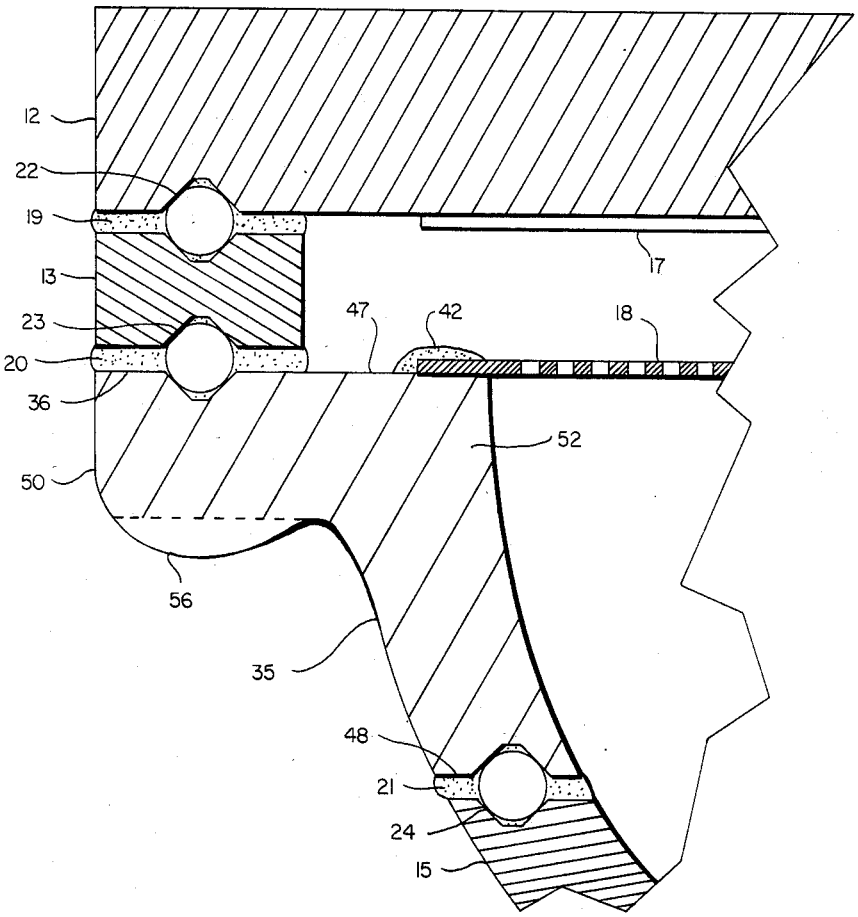
FIG. 4 is a partial cross-section through a portion of an assembled support frame and panel in accordance with the invention.

In the enlarged cross-section of FIG. 4, the details of support frame 14 are more clearly shown. Support frame 14 includes a radially outwardly and axially forwardly extending flange means 50 extending into a shelf means 52 extending radially inwardly from the flange 50. The shelf 52 has a paneldirected support surface 47 for supporting tensed mask 18 about its periphery by means of a frit bond 42. It will be noted that the flange 50 is shown as being thicker radially than the shelf 52 is axially. The shelf 52 provides a support surface for the edges of the tensed mask. The flange 50 further includes a separate spacer ring 13 attached thereto, and forming a seal surface 36 that is outwardly displaced from the support surface. Spacer ring 13 is bonded between the periphery of panel 12 and seal surface 36 on flange 50 by means of frit bonds 19 and 20. Shelf 52 terminates in a skirt 35, that extends away from panel 12 and axially inwardly from the shelf 52; this assembly forms a part of the envelope of the tube. The end face of skirt 35 terminates in a seal end 48 that is subsequently joined by frit bond 21 to the mating end of the tube funnel 15. Thus the skirt 35 lends stiffness to the support frame 14 to resist distortion by the tension in the tensed mask.

It will be readily appreciated by those skilled in the art that registration means or registration-affording means such as those disclosed in the above-mentioned copending applications may be incorporated in the corresponding seal surface of the panel, the Q-spacer rings, and the support frame, or may be provided externally of these elements. Appropriate registration means are preferably also included between seal end 48 of the support frame and the corresponding mating surface on the funnel of the tube to assure alignment of the neck of the tube (and consequently the electron gun structure housed therein) with the tensed shadow mask and phosphor screen. If conventional exposure stations often referred to as "lighthouses" and techniques are employed for screening, registration means at seal end 48 are needed for proper alignment of the support frame when forming the phosphor screen 17 on the inner surface of panel 12. To this end "ball and groove" registration means 22, 23 and 24 are shown between the panel and spacer ring, the spacer ring and support frame and the support frame and funnel, respectively. These registration means are fully disclosed in the referent copending applications.

A thickened portion 56 is included on the underside of flange 50, the terminus of which is indicated by the dashed line. The purpose of portion 50 is to provide added rigidity to flange 50. It will be further appreciated that manufacturing techniques may preclude use of such a thickened portion. For example, if support frame 14 is formed by a pressed-glass process, too rapid contraction of the glass in the mold may result in interference and cracking of such a thickened portion. Thus in some manufacturing processes, the thickened portion 56 of the support frame may be omitted, as indicated by the dashed line.

The advantages of the novel support frame should be readily apparent. First, the mask is supported wholly within the tube envelope and therefore no added protection is required to insulate against the very high potential applied to the mask. The support frame resists lateral deflection during screening and thus an undistorted phosphor pattern is formed on the panel. Here again it will be appreciated that the same advantage obtains when screening a "black-surround" or grille pattern, on the panel, as is commonly done in modern tubes. Also, the tube manufacturing processes need to change very little with the novel support frame insofar as the manufacture of the envelope is concerned; that is, substantially the same temperature cycles may be used in fabricating this tensed mask tube as those used in the manufacture of a conventional color tube of similar size.

It will be recognized that numerous modifications and changes in the described embodiment of the invention will be apparent to those skilled in the art without departing from its true spirit and scope.

What is claimed is:

1. An annular support frame for a flat face panel for a cathode ray tube adapted to support a tensed mask within the tube, with a precise spacing between the panel and the tensed mask, and for forming an integral portion of the envelope of the completed tube, said support frame comprising:

continuous flange means having a seal surface for joining to the periphery of the flat panel;

shelf means inwardly disposed from the flange means and providing a support surface for the edges of the tensed mask; and skirt means extending axially rearwardly from the shelf means and including a seal end for joining to a funnel portion of the tube envelope, said skirt means lending stiffness to said support frame to enable said support frame to resist distortion by the tension in said tensed mask.

2. The support frame of claim 1 wherein the radial thickness of said flange means is greater than the axial length of said shelf means.

3. The support frame of claim 1 wherein said seal surface is axially offset from the support surface on the shelf means by a distance designed to provide a precise Q-distance between the tensed mask and the inner surface of the panel.

4. The support frame of claim 3 wherein the flange means further includes a separate spacer ring attached thereto and forming said seal surface, said seal surface being displaced from the support surface.

5. A cathode ray tube including a flat panel, a tensed mask, a generally bell-shaped envelope section and an annular support frame structurally bonded between the flat panel and the envelope section for supporting the tensed mask wholly within said tube in a fiexed spaced relationship to the inner surface of the flat panel, the support frame comprising:

a flange defining a seal surface parallel to the flat panel for joining to the periphery of the flat panel;

a shelf inwardly disposed from and parallel to said seal surface and offset therefrom for determining the fixed spaced relationship and for providing a support surface for supporting the tensed mask; and, a skirt rearwardly extending from said shelf and forming a part of the envelope of the tube, said skirt lending stiffness to said support frame to enable said support frame to resist distortion by the tension in said tensed mask.

6. The cathode ray tube of claim 5 wherein said flange includes a separate spacer ring for defining said seal surface.

7. A color cathode ray tube comprising:

a funnel having a seal land;

a flat faceplate comprising a target surface having a pattern of phosphor areas deposited thereon, and a sealing land circumscribing said target surface, said faceplate having registration-affording means selectively located and oriented thereon;

a color selection electrode assembly permitting selective excitation of said phosphor areas by a scanning beam of electrons comprising:

frame means defining a central opening dimensioned to enclosed said target surface of said faceplate, and comprising a pair of substantially flat, axially spaced surfaces comprising seal lands;

a planar tensed foil supported by said frame means and having a predetermined pattern of apertures;

indexing means mechaniclaly associated with said frame means and cooperable with said faceplate registration-affording means to permit precise registration between said aperture and said faceplate, said indexing means and said faceplate being structured to facilitate multiple registered matings of said frame means and said registration-affording means during screening of said faceplate target surface; and sealing means disposed between confronting seal lands of said frame means and said faceplate;

said frame means having a substantial depth for increasing the structural strength of said color selection electrode assembly so as to reduce deformation thereof by said tensed foil.

* * * * *